US010943556B2

(12) United States Patent
Chen et al.

(10) Patent No.: US 10,943,556 B2
(45) Date of Patent: Mar. 9, 2021

(54) DATA DRIVER AND DRIVING METHOD FOR DRIVING DISPLAY PANEL

(71) Applicant: NOVATEK Microelectronics Corp., Hsin-Chu (TW)

(72) Inventors: Peng-Yu Chen, Hsinchu (TW); Yu-Shao Liu, Kaohsiung (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 16/909,934

(22) Filed: Jun. 23, 2020

(65) Prior Publication Data

US 2020/0410950 A1 Dec. 31, 2020

Related U.S. Application Data

(60) Provisional application No. 62/866,625, filed on Jun. 26, 2019.

(51) Int. Cl.
*G09G 3/36* (2006.01)

(52) U.S. Cl.
CPC ..... *G09G 3/3685* (2013.01); *G09G 3/3614* (2013.01); *G09G 2310/027* (2013.01); *G09G 2310/0289* (2013.01); *G09G 2310/08* (2013.01)

(58) Field of Classification Search
CPC ..... G09G 3/3685; G09G 3/3614; G09G 2310/0289; G09G 2310/027; G09G 2310/08
See application file for complete search history.

(56) References Cited

U.S. PATENT DOCUMENTS

2010/0259522 A1* 10/2010 Weng ..... G09G 3/3648 345/208
2013/0234954 A1* 9/2013 Koide ..... G09G 3/3648 345/173
2014/0009511 A1* 1/2014 Hsiao ..... G09G 3/3685 345/690
2016/0155401 A1* 6/2016 Lee ..... G09G 3/3614 345/694
2016/0189600 A1* 6/2016 Shin ..... G09G 3/3688 345/209
2018/0096666 A1* 4/2018 Chung ..... G09G 3/3696
2018/0366077 A1* 12/2018 Higuchi ..... H03F 3/45269
2020/0097112 A1* 3/2020 Seo ..... G06F 3/0412

* cited by examiner

*Primary Examiner* — Andrew Sasinowski
(74) *Attorney, Agent, or Firm* — Winston Hsu

(57) ABSTRACT

A data driver for driving a display panel includes a first driving channel coupled to a polarity inversion circuit and configured to generate a first data voltage signal having a positive polarity output to the display panel according to a plurality of first pixel data; a second driving channel coupled to the polarity inversion circuit and configured to generate a second data voltage signal having a negative polarity output to the display panel according to a plurality of second pixel data; wherein the first data voltage signal is output to first output node through the polarity inversion circuit during a first line period and the second data voltage signal is output to the first output node through the polarity inversion circuit during a second line period after the first line period, and the first line period and the second line period respectively belong to two consecutive frame periods.

24 Claims, 10 Drawing Sheets

DATA DRIVER AND DRIVING METHOD FOR DRIVING DISPLAY PANEL

CROSS REFERENCE TO RELATED APPLICATIONS

This application claims the benefit of U.S. Provisional Application No. 62/866,625 filed on 2019 Jun. 26, the contents of which are incorporated herein in their entirety.

BACKGROUND OF THE INVENTION

1. Field of the Invention

The present invention relates to a data driver and driving method for driving a display panel, and more particularly, to a data driver and driving method capable of reducing charge/discharge current to a load when exchanging polarities of output nodes of the data driver.

2. Description of the Prior Art

During driving a display panel, when exchanging polarities of output nodes of a data driver, large charge/discharge current would be generated at the data driver to a load on the display panel. A general solution is that a timing controller outputs a specific gray level data to a data driver before the data driver performs the polarity exchange, such that a positive polarity driving channel of the data driver outputs a positive polarity voltage, which is close to a negative polarity, and a negative polarity driving channel of the data driver outputs a negative polarity voltage, which is close to a positive polarity. In such a way, the data driver can reduce the charge/discharge current to the load generated when exchanging the polarities of output nodes.

The data driver may be a die mounted on a glass substrate of the panel, which means the package type is Chip on Glass (COG), and power and grounding are provided to the data driver through traces on the glass substrate. Since impedances of the traces on the glass substrate are higher than those of copper wires, when load charges on the panel move to the power/ground terminals of the data driver, voltage of the power may decrease or voltage of the ground may increase. When the voltage of power/ground is not stable, operations of the data driver would be affected.

SUMMARY OF THE INVENTION

The present invention provides a data driver and driving method for driving display panel to reduce charge/discharge current to a load generated when exchanging polarities of output nodes of the data driver.

An embodiment of the present invention discloses a data driver for driving a display panel, comprises a first output node; a polarity inversion circuit coupled to the first output node; a first driving channel coupled to the polarity inversion circuit and configured to generate a first data voltage signal having a positive polarity output to the display panel according to a plurality of first pixel data; a second driving channel coupled to the polarity inversion circuit and configured to generate a second data voltage signal having a negative polarity output to the display panel according to a plurality of second pixel data; a control unit configured to determine whether a polarity arrangement corresponding to each display line inverts; wherein the first data voltage signal is output to the first output node through the polarity inversion circuit during a first line period and the second data voltage signal is output to the first output node through the polarity inversion circuit during a second line period after the first line period, and the first line period and the second line period respectively belong to two consecutive frame periods; and wherein in response to determining that the polarity arrangement of the display line changes, a first voltage is output to the first output node during a third line period which is between the first line period and the second line period.

Another embodiment of the present invention discloses a driving method for a data driver for driving a display panel, wherein the data driver comprises a control unit, a polarity inversion circuit, a first output node, and a plurality of driving channels, each driving channel comprising a latch circuit, a level shift circuit and a digital-to-analog conversion circuit, the driving method comprises generating, by a first driving channel of the plurality of driving channels, a first data voltage signal having a positive polarity output to the display panel according to a plurality of first pixel data; generating, by a second driving channel of the plurality of driving channels, a second data voltage signal having a negative polarity output to the display panel according to a plurality of second pixel data, wherein the first data voltage signal is output to the first output node through the polarity inversion circuit during a first line period and the second data voltage signal is output to the first output node through the polarity inversion circuit during a second line period after the first line period, and the first line period and the second line period respectively belong to two consecutive frame periods; and determining, by the control unit, whether a polarity arrangement corresponding to each display line inverts; in response to determining that the polarity arrangement of the display line changes, outputting a first voltage to the first output node during a third line period which is between the first line period and the second line period.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
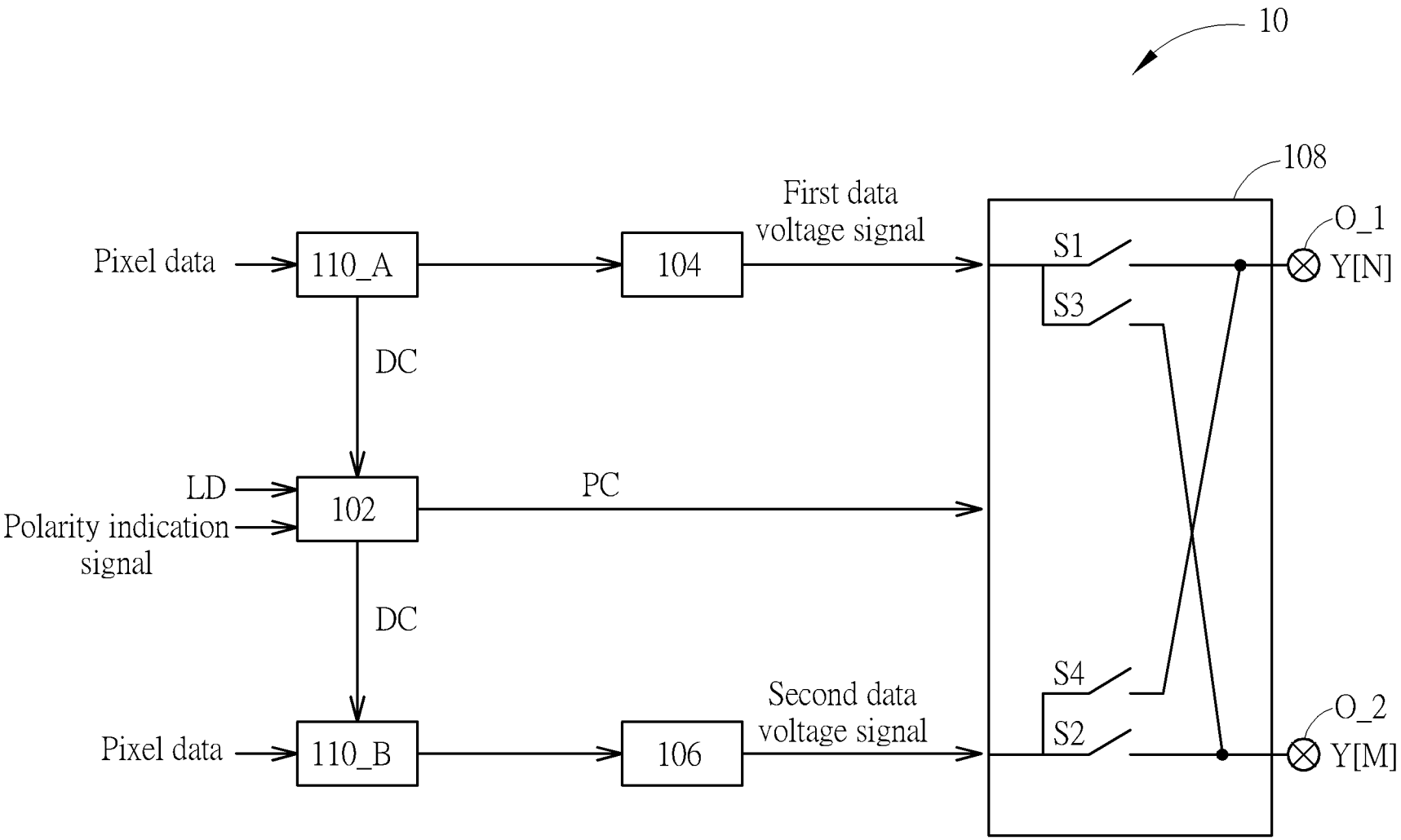
FIG. 1 is a schematic diagram of a data driver according to an embodiment of the present invention.

Please refer to FIG. 1, which is a schematic diagram of a data driver 10 according to an embodiment of the present invention. The data driver 10 is utilized for driving a display panel. The data driver 10 includes a control unit 102, a first driving channel 104, a second driving channel 106, a polarity inversion circuit 108 and output selectors 110_A and 110_B. The control unit 102 is coupled to a timing controller (not illustrated in the figures) and configured to determine whether a polarity arrangement corresponding to each display line of the display panel inverts or not. The first driving channel 104 is configured to generate a first data voltage signal having a positive polarity output to the display panel according to a plurality of first pixel data. The second driving channel 106 is configured to generate a second data voltage signal having a negative polarity output to the display panel according to a plurality of second pixel data. The polarity inversion circuit 108 includes a plurality of switches S1-S4 and is coupled to the first driving channel 104, the second driving channel 106, a first output node O_1 and a second output node O_2. Y[N] denotes a data voltage signal output by the first output node O_1 and Y[M] denotes a data voltage signal output by the second output node O_2. The first output node O_1 and the second output node O_2 are a part of a plurality of data output nodes of the data driver 10 by which the data voltage signals are transmitted through to the display panel. Each of the data output nodes may be coupled to one or more (e.g., three) data lines of the display panel. In other words, Y[N] or Y[M] may drive one corresponding subpixel column, or drive multiple subpixel columns in a time-divisionally manner.

In order to prevent liquid crystal cells from being always polarized in the same direction, the display panel may adopt an inversion scheme for changing the polarity of each subpixel by frames. In this embodiment, the display panel may adopt a column inversion scheme, in which data voltage signals output through a data output node (such as, O_1) during all horizontal line periods (called line periods hereinafter) of the $N^{th}$ frame period may have the same positive polarity, and data voltage signals output through the same data output node during the $(N+1)^{th}$ frame period may have the same negative polarity. The first driving channel 104 is configured to generate the first data voltage signal of positive polarity, and the second driving channel 106 is configured to generate the second data voltage signal of negative polarity. Since the output nodes O_1 may transmit positive polarity data voltage signals in the $N^{th}$ frame and transmit negative polarity data voltage signals in the $(N+1)^{th}$ frame, the polarity inversion circuit 108 (comprising switches) is required and is disposed between the driving channels 104 and 106 and the output nodes O_1 and O_2. The polarity inversion circuit 108 is utilized for exchanging the polarity of data voltage signals transmitted through the first output node O_1 and the second output node O_2 according to a polarity control signal PC generated by the control unit 102. In this description, exchanging the polarities of data voltage signals transmitted through the first output node O_1 and the second output node O_2 is also described in another words as exchanging the polarities of the first output node O_1 and the second output node O_2. For example, in a first frame, when the subpixel (or subpixel column) which receives the data voltage signal Y[N] of the first output node O_1 is predetermined to display data voltage signals of positive polarity, the first data voltage signals of positive polarity generated by the first driving channel 104 are transmitted to the first output node O_1 via the polarity inversion circuit 108. In a blanking period, which means there is no pixel data to be displayed, in the first frame, the logical level of the polarity control signal PC is controlled by the control unit 102 to transit from high to low (or low to high) such that the polarity inversion circuit 108 can perform polarity inversion, i.e., to cut off a connection between a driving channel and an output node and to conduct another connection between the driving channel and another output node. Therefore, in a second frame following the first frame, when the subpixel (or subpixel column) which receives the data voltage signal Y[N] of the first output node O_1 is predetermined to display data voltage signals of negative polarity, the second data voltage signals of negative polarity generated by the second driving channel 106 are transmitted to the first output node O_1 via the polarity inversion circuit 108. Similarly, in a first frame, the second data voltage signals of negative polarity generated by the second driving channel 106 are transmitted to the second output node O_2 via the polarity inversion circuit 108, and in a second frame, the first data voltage signals of positive polarity generated by the first driving channel 104 are transmitted to the second output node O_2 via the polarity inversion circuit 108.

The output selector 110_A is coupled to the control unit 102 and the first driving channel 104, and configured to selectively output the first pixel data such that the first driving channel 104 generates the first data voltage signals accordingly or output a first preconfigured data to the first driving channel 104 such that the first driving channel 104 generates the first voltage corresponding to the first preconfigured data accordingly. The output selector 110_B is coupled to the control unit 102 and the second driving channel 106 and configured to selectively output the second pixel data such that the second driving channel 106 generates the second data voltage signals accordingly or output a second preconfigured data to the second driving channel 106, such that the second driving channel 106 generates the second voltage corresponding to the second preconfigured data accordingly. Each driving channel includes a digital-to analog conversion circuit such that data can be conversed to analog voltage signals.

In detail, the control unit 102 determines whether the polarity arrangement corresponding to each display line of the display panel inverts according to a polarity indication signal transmitted from the timing controller, and the control unit 102 generates a data control signal indicating that the polarity arrangement corresponding to each display line inverts or not. The control unit 102 may transmit a data control signal DC to the output selector 110_A and the output selector 110_B for indicating the polarity arrangement corresponding to each display line of the display panel, such that the output selector 110_A may be able to selectively output the first pixel data or output the first preconfigured data corresponding to the first voltage to the first driving channel 104 and the output selector 110_B may be able to selectively output the second pixel data or output the second preconfigured data corresponding to the second voltage to the second driving channel 106.

In addition, the control unit 102 is configured to generate a polarity control signal PC for controlling the polarity inversion circuit 108. Please refer to FIG. 2, which is a timing diagram of data voltage signals output by two driving channels with opposite polarities, polarity indication signal, data control signal DC, the polarity control signal according to an embodiment of the present invention. In the upper diagram of FIG. 2, a solid line represents the first data voltage signal output by the first driving channel 104 and a dash line represents the second data voltage signal output by the second driving channel 106, and in the lower diagram of FIG. 2, a solid line represents the data voltage signal Y[N] output through the first output node O_1 and a dash line represents the data voltage signal Y[M] output through the second output node O_2.

In this embodiment, the polarity control signal PC is utilized for controlling the on/off states of switches S1-S4 of the polarity inversion circuit 108. The polarity inversion is performed by the polarity inversion circuit 108 in response to that the polarity control signal PC transits from logic 1 to logic 0.

Figure 2:
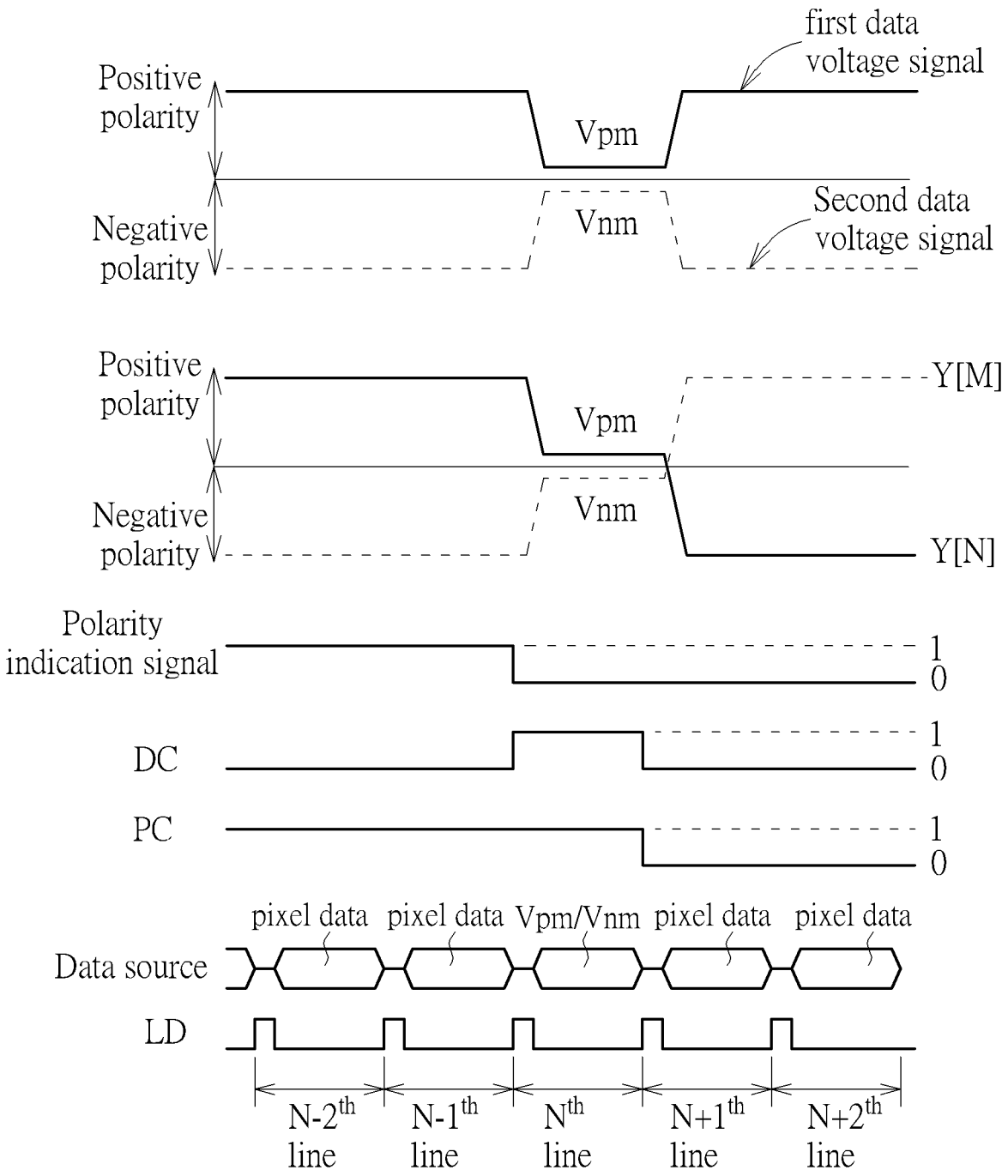
FIG. 2 is a timing diagram of data voltage signals output by two driving channels with opposite polarities, a polarity indication signal, a data control signal, a polarity control signal, and data source according to an embodiment of the present invention.

The polarity indication signal represented by logic levels 1 and 0, from the timing controller, indicates a polarity arrangement rule of each display line of the display panel. For example, when the polarity arrangement of the data driver 10 is under column inversion scheme, a polarity arrangement rule of each display line in a first frame is identical, i.e. +−+−+−+− . . . , which may correspond to logic level 1 of the polarity indication signal. In a second frame following the first frame, the polarity arrangement rule of each display line is inverted, i.e. −+−+−+−+ . . . , which corresponds to logic level 0 of the polarity indication signal. As shown in FIG. 2, the polarity indication signal indicates the polarity arrangement rule changes, which happens earlier than the polarity control signal PC indicating polarity inversion.

Therefore, the timing controller is not required to transmit the first preconfigured data corresponding to the first voltage Vpm of positive polarity and the second preconfigured data corresponding to the second voltage Vnm of negative polarity to the data driver 10 before polarity inversion. The data driver 10 may generate the first/second preconfigured data by the data driver itself based on the polarity indication signal.

As shown in FIG. 2, before the polarity indication signal is changed from the logic level 1 to 0, i.e. before $N^{th}$ line period, the pixel data are arbitrary data from the timing controller. When the polarity indication signal changes and the control unit 102 detects the change of the polarity indication signal from the timing controller, the data control signal DC generated by the control unit 102 and transmitted to the output selector 110_A is changed from the logic level 0 to the logic level 1, to invert the polarity arrangement corresponding to each display line. In this embodiment, in the $N^{th}$ line period, the output selector 110_A is indicated by the data control signal DC so as to output the first voltage Vpm of positive polarity, which is close to a middle voltage of an operating voltage range of the data driver 10, and the output selector 110_B is indicated by the data control signal DC so as to output the second voltage Vnm of negative polarity, which is close to the middle voltage. When the polarity inversion circuit 108 receives a corresponding polarity control signal PC which transits from logic level 1 to logic level 0, the polarity inversion circuit 108 accordingly exchanges the polarities of the first output node O_1 and the second output node O_2 before $N+1^{th}$ line period starts. As shown in FIG. 2, the polarities of the data voltage signal Y[N] of the first output node O_1 and the data voltage signal Y[M] of the second output node O_2 are inverted before the $N+1^{th}$ line period by the polarity inversion circuit 108.

Figure 3:
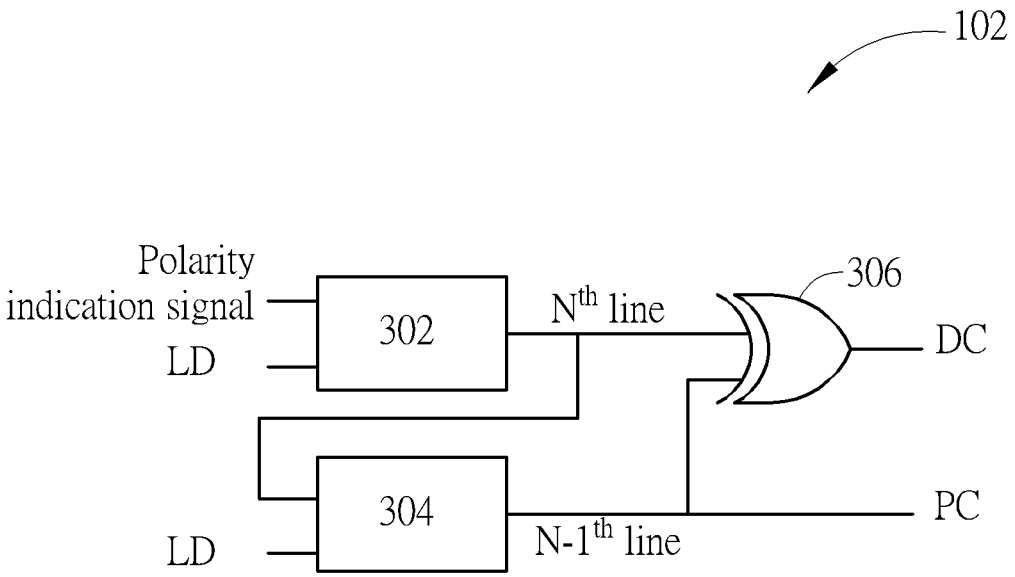
FIG. 3 is a schematic diagram of a control unit according to an embodiment of the present invention.

FIG. 3 is a schematic diagram of the control unit 102 according to an embodiment of the present invention. In this embodiment, the control unit 102 includes a first D flip-flop circuit 302, a second D flip-flop circuit 304 and a logic XOR circuit 306. The first D flip-flop circuit 302 and the second D flip-flop circuit 304 are coupled to the timing controller to receive the polarity indication signal and a control signal LD which indicates to load data. The control unit 102 generates the data control signal DC and the polarity control signal PC according to the polarity indication signal and the control signal LD.

Figure 4A:
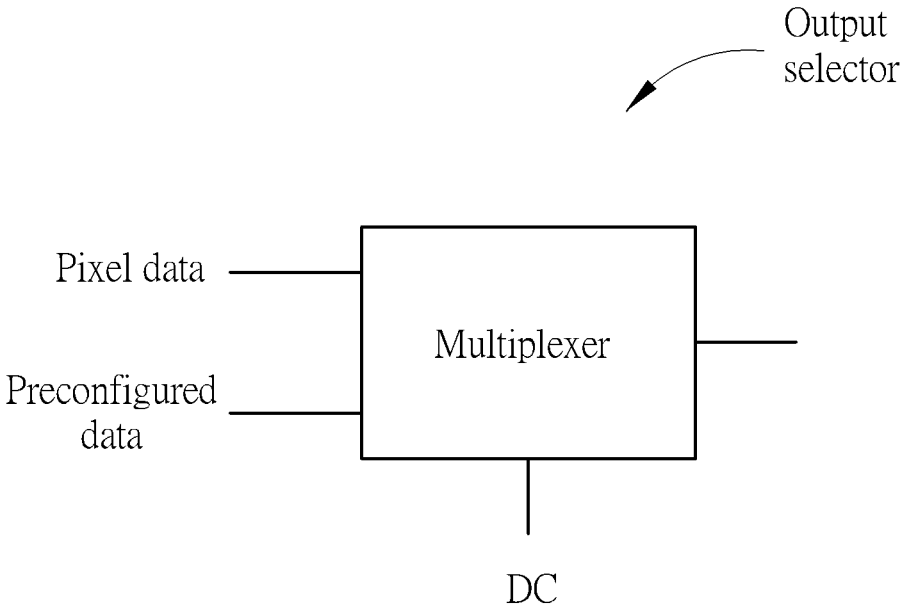
FIGS. 4A and 4B are schematic diagrams of an output selector according to embodiments of the present invention.
Figure 4B:
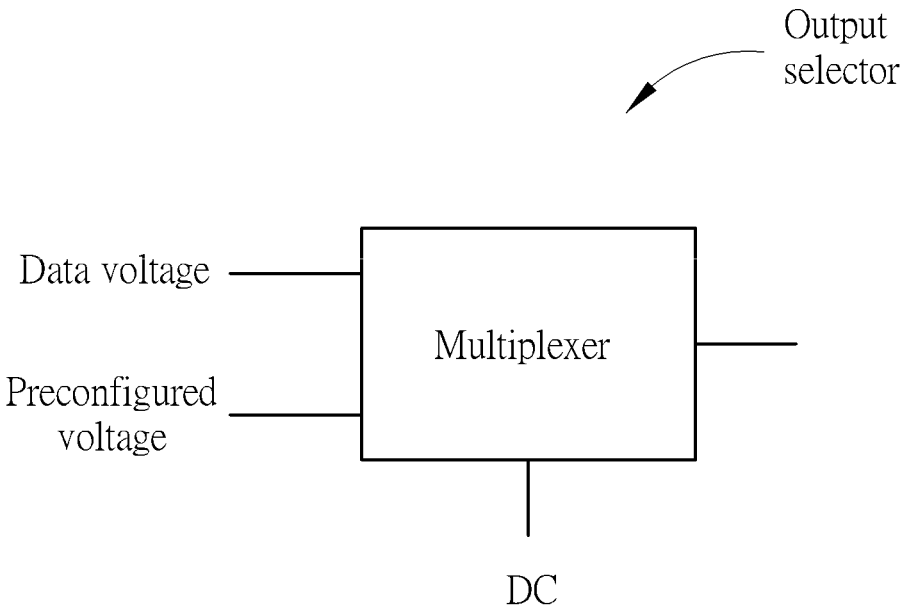

FIGS. 4A and 4B are schematic diagrams of the output selector according to embodiments of the present invention. In FIG. 4A, the output selector may be a multiplexer, which is configured to selectively output a pixel data from the timing controller or a preconfigured data stored in the data driver according to the data control signal DC. In another embodiment, as shown in FIG. 4B, the output selector may be configured to selectively output a data voltage signal generated in the data driver or a preconfigured voltage according to the data control signal DC.

Figure 5:
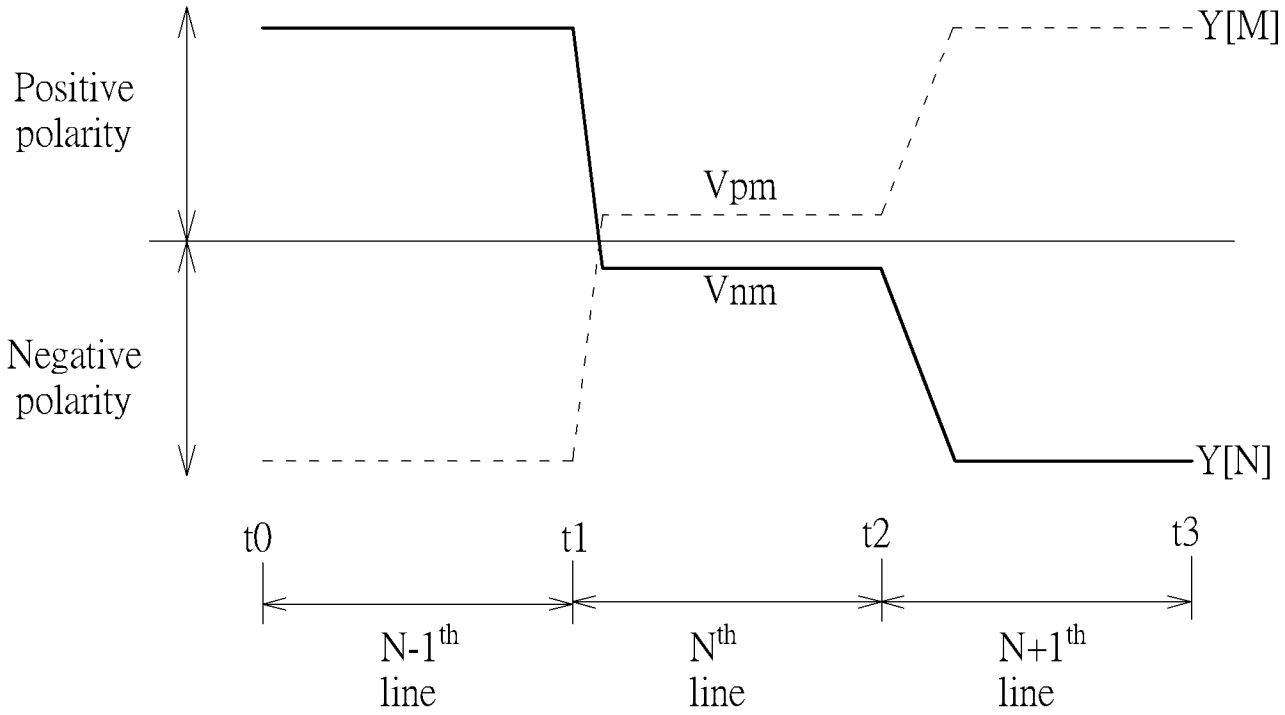
FIG. 5 is a timing diagram of data voltage signals output through two output nodes of opposite polarities according to an embodiment of the present invention.

FIG. 5 is a timing diagram of data voltage signals output through two output nodes of opposite polarities according to embodiments of the present invention. As shown in FIG. 5, the polarities of the data voltage signal Y[N] of the first output node O_1 and the data voltage signal Y[M] of the second output node O_2 are inverted at a timing t1, which is between $N-1^{th}$ line period and $N^{th}$ line period of the display panel. Different with FIG. 2, an exchanging timing of polarities illustrated in FIG. 5 is a line period earlier than that of FIG. 2.

Figure 6:
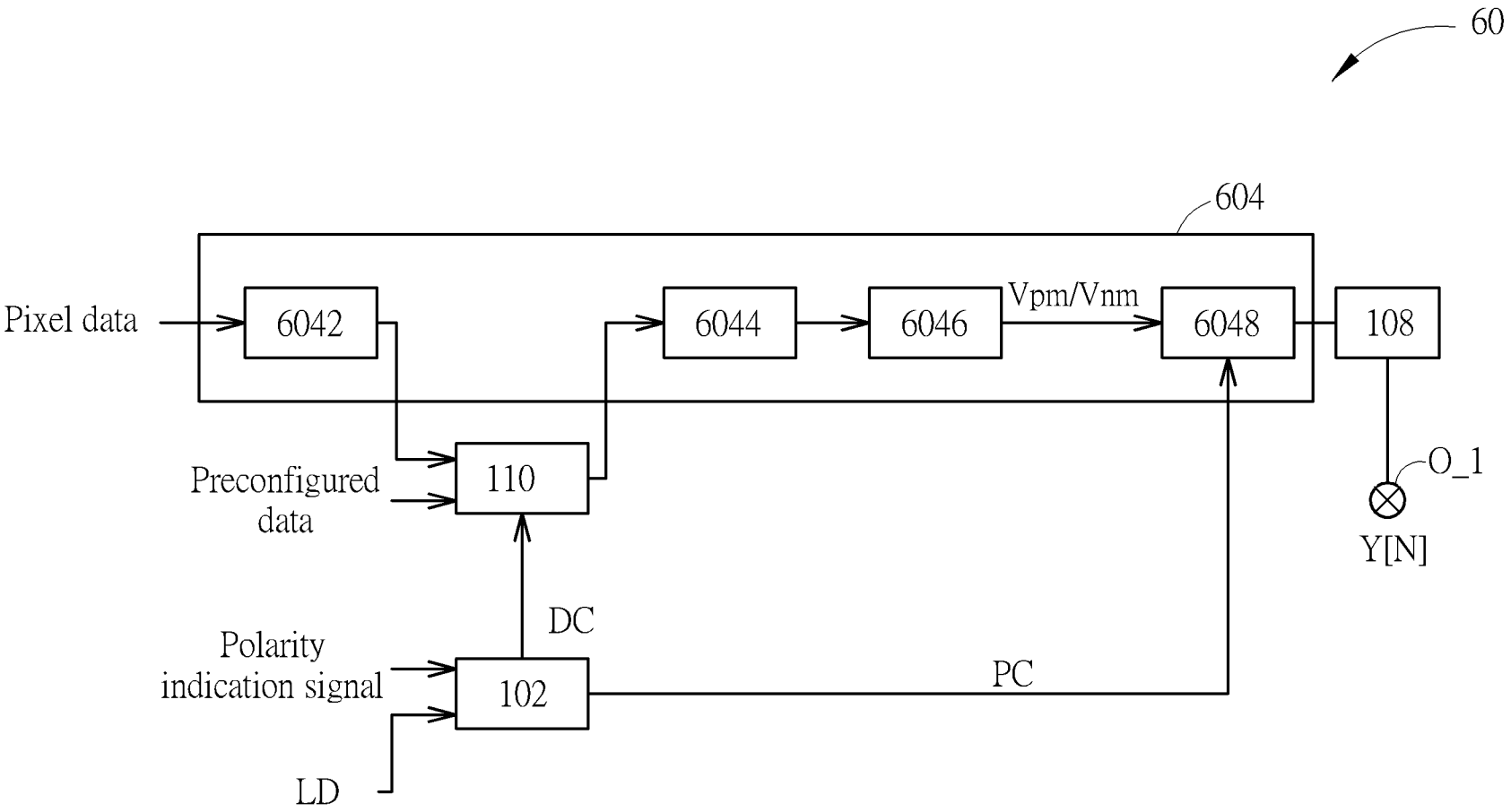
FIGS. 6-10 are schematic diagrams of another data driver according to embodiments of the present invention.
Figure 7:
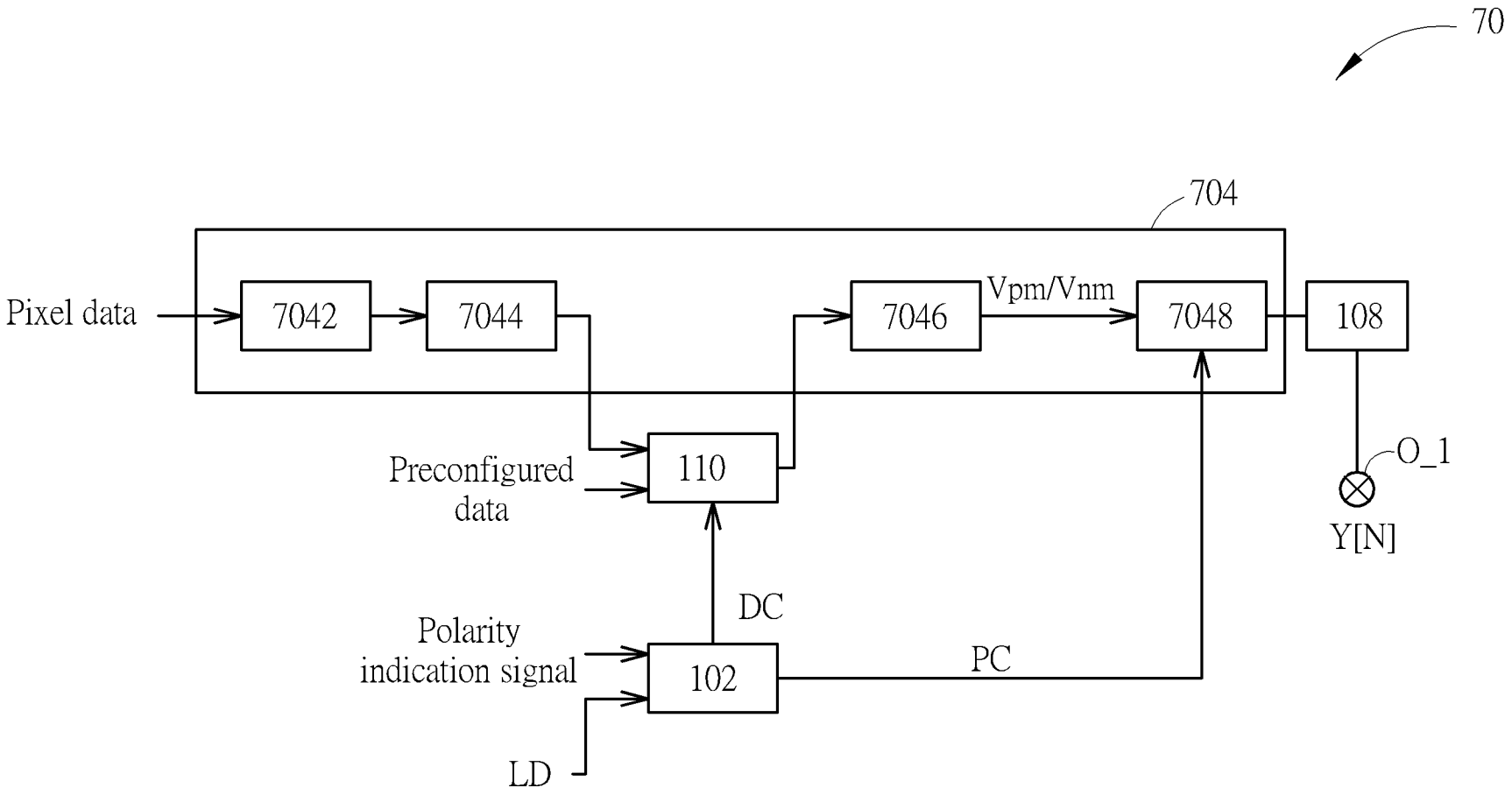
Figure 8:
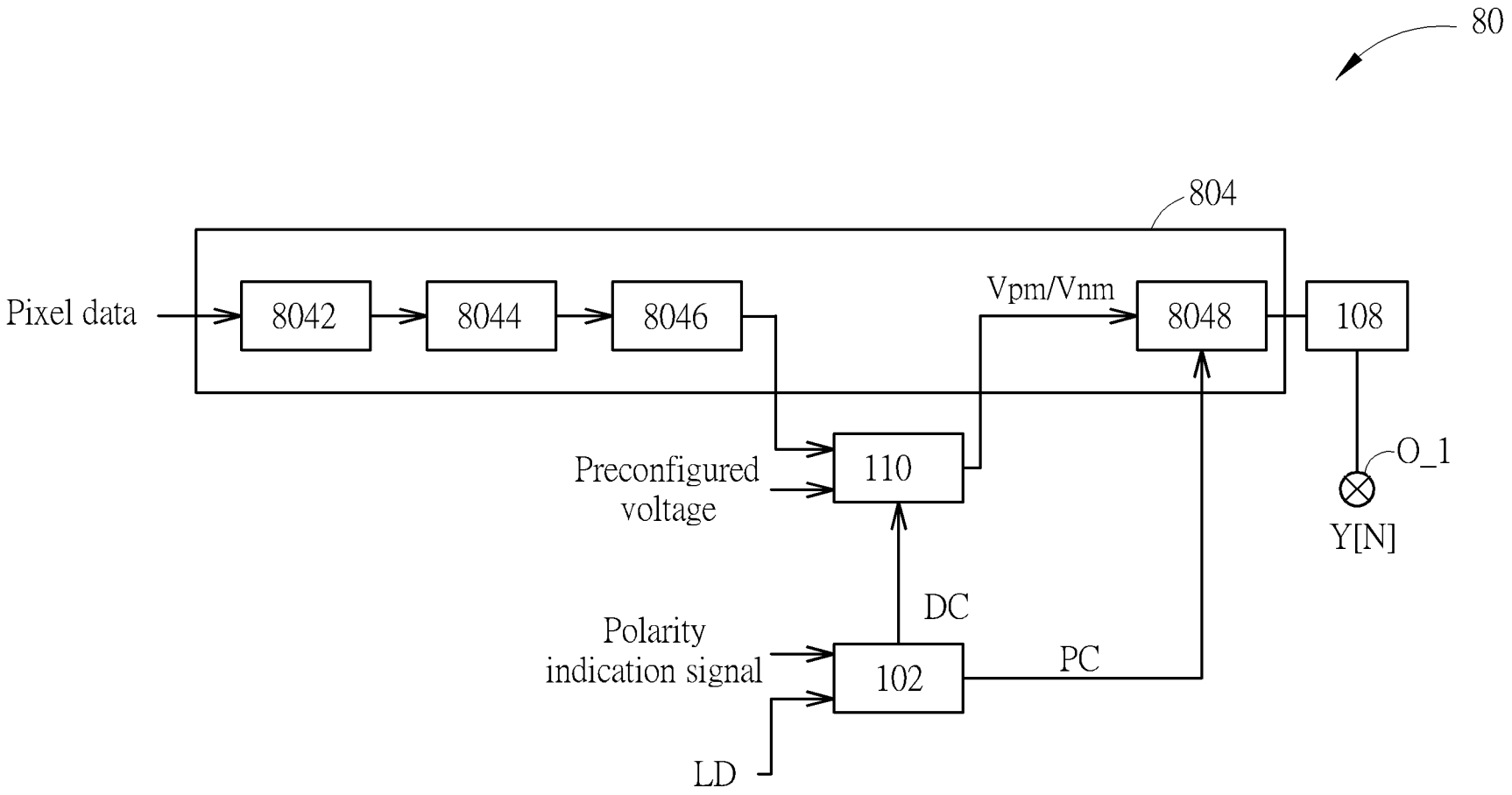

In addition to the implementation of the output selectors 110_A, 110_B shown in FIG. 1, the output selectors 110_A, 110_B may be implemented in other ways. FIGS. 6-8 are schematic diagrams of the data drivers 60-80 according to embodiments of the present invention. For brevity, only single driving channel, i.e. the first driving channel, is illustrated herein and other elements with same function inherent the same reference signs.

As shown in FIG. 6, the data driver 60 includes the control unit 102, a first driving channel 604, the polarity inversion circuit 108 and the output selector 110. The first driving channel 604 includes a latch circuit 6042, a level shift circuit 6044, a digital-to-analog conversion circuit 6046 and an output buffer 6048. In this embodiment, the output selector 110 may selectively output the pixel data from the latch circuit 6042 or output the preconfigured data which is corresponding to preconfigured voltage (Vpm or Vnm) to the level shift circuit 6044 according to the data control signal DC from the control unit 102.

As shown in FIG. 7, the data driver 70 includes the control unit 102, a first driving channel 704, the polarity inversion circuit 108 and the output selector 110. The first driving channel 704 includes a latch circuit 7042, a level shift circuit 7044, a digital-to-analog conversion circuit 7046 and an output buffer 7048. In this embodiment, the output selector 110 may selectively output the pixel data being converted by the level shift circuit 7044 or output the preconfigured data which is corresponding to preconfigured voltage (Vpm or Vnm) to the digital-to-analog conversion circuit 7046 according to the data control signal DC from the control unit 102.

Moreover, as shown in FIG. 8, the data driver 80 includes the control unit 102, a first driving channel 804, the polarity inversion circuit 108 and the output selector 110. The first driving channel 804 includes a latch circuit 8042, a level shift circuit 8044, a digital-to-analog conversion circuit 8046 and an output buffer 8048. In this embodiment, the output selector 110 may selectively output the data voltage signal being converted by the digital-to-analog conversion circuit 8046 or output a preconfigured voltage (Vpm or Vnm) or a middle voltage HVDDA of an operating voltage range of the data driver 80 to the output buffer 8048 according to the data control signal DC from the control unit 102.

Figure 9:
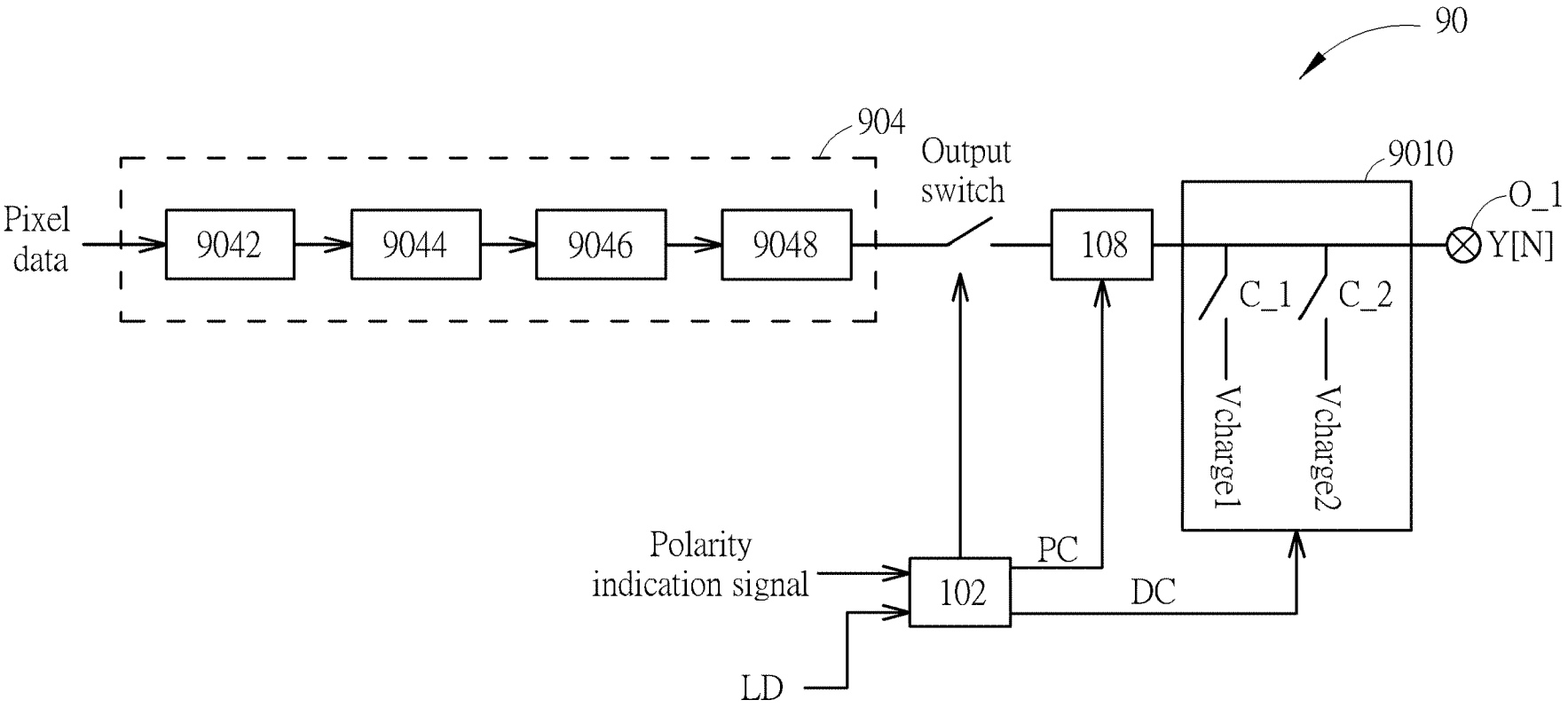
Figure 10:
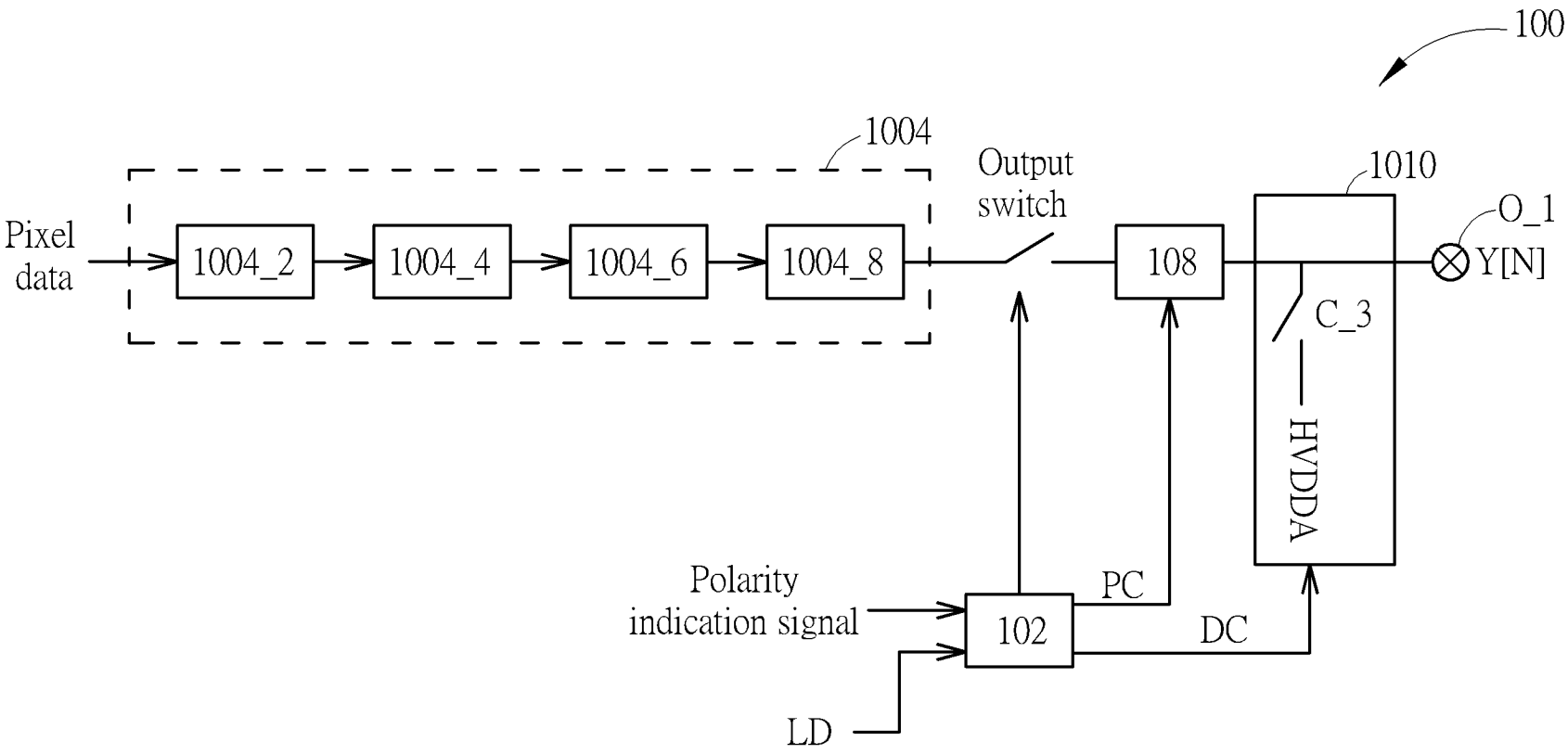

In other embodiments, the control unit 102 is configured to control the output selector. FIGS. 9-10 are schematic diagrams of data drivers 90, 100 according to embodiments of the present invention. For brevity, only single driving channel, i.e. the first driving channel, is illustrated herein and other elements with same function inherent the same reference signs.

As shown in FIG. 9, the data driver 90 includes the control unit 102, a first driving channel 904, the polarity inversion circuit 108, an output selector 9010 and an output switch. The first driving channel 904 includes a latch circuit 9042, a level shift circuit 9044, a digital-to-analog conversion circuit 9046 and an output buffer 9048. The output switch is coupled between the first driving channel 904 and the polarity inversion circuit 108. In this embodiment, the output selector 9010 includes a plurality of charge switches C_1 and C 2, which is coupled between the polarity inversion circuit 108 and the first output node O_1 and is configured to selectively charge the first output node O_1 by a voltage Vcharge1 or the other voltage Vcharge2 according to the data control signal DC from the control unit 102. Vcharge1 may be a positive voltage close to a middle voltage of an operating voltage range of the data driver 90, and Vcharge2 may be a negative voltage close to a middle voltage of an operating voltage range of the data driver 90.

In detail, when the polarities of data output nodes of the data driver 90 is not changed, the output switch is normally on and off and the charge switches C_1 and C 2 are off; when the polarity of the first output node O_1 is changed, the output switch is off, the charge switch C_1 is turned on so that the first output node O_1 is charged to voltage Vcharge1, or the charge switch C 2 is turned on so that the first output node O_1 is charged to voltage Vcharge2.

The data driver 100 includes the control unit 102, a first driving channel 1004, the polarity inversion circuit 108, an output selector 1010 and an output switch. The first driving channel 1004 includes a latch circuit 1004_2, a level shift circuit 1004_4, a digital-to-analog conversion circuit 1004_6 and an output buffer 1004_8. The output switch is coupled between the first driving channel 1004 and the polarity inversion circuit 108. In this embodiment, the output selector 1010 includes a charge switch C_3, which is coupled between the polarity inversion circuit 108 and the first output node O_1 and is configured to charge the first output node O_1 to a voltage HVDDA according to the data control signal DC from the control unit 102.

In detail, when the polarities of data output nodes of the data driver 100 is not changed, the output switch is normally on and off and the charge switch C_3 is off; when the polarity of the first output node O_1 is changed, the output switch is off, and the charge switch C_3 is turned on to charge the first output node O_1 to a middle voltage HVDDA of an operating voltage range of the data driver 100, according to the data control signal DC from the control unit 102.

Therefore, the data driver and the driving method for driving display panel of the present invention outputs specific voltage data when detecting the exchanging of polarity to reduce charge/discharge current. Moreover, those skilled in the art may properly implement the data driver and the driving method according to different requirements, which is not limited to above embodiments and is applicable to the present invention.

In summary, the embodiments of the present invention provides a data driver and a driving method for driving display panel, which reduces charge/discharge current of a load on the display panel when polarities of the data output nodes of the data driver inverses.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A data driver for driving a display panel, comprising:

a first output node;

a polarity inversion circuit coupled to the first output node;

a first driving channel coupled to the polarity inversion circuit and configured to generate a first data voltage signal having a positive polarity output to the display panel according to a plurality of first pixel data;

a second driving channel coupled to the polarity inversion circuit and configured to generate a second data voltage signal having a negative polarity output to the display panel according to a plurality of second pixel data; and a control unit configured to determine whether a polarity arrangement corresponding to each display line inverts;

wherein the first data voltage signal is output to the first output node through the polarity inversion circuit during a first line period and the second data voltage signal is output to the first output node through the polarity inversion circuit during a second line period after the first line period, and the first line period and the second line period respectively belong to two consecutive frame periods;

wherein in response to determining that the polarity arrangement of the display line changes, a first voltage is output to the first output node during a third line period which is between the first line period and the second line period.

2. The data driver of claim 1, further comprising an output selector coupled to the control unit and the first driving channel and configured to selectively output the plurality of first pixel data or output a preconfigured data corresponding to the first voltage to the first driving channel such that the first voltage is generated by the first driving channel.

3. The data driver of claim 2, wherein the output selector selectively outputs the plurality of first pixel data transmitted from a timing controller or outputs the preconfigured data to a latch circuit of the first driving channel.

4. The data driver of claim 2, wherein the output selector selectively outputs the plurality of first pixel data stored in a latch circuit of the first driving channel or outputs the preconfigured data to a level shift circuit of the first driving channel.

5. The data driver of claim 2, wherein the output selector selectively outputs the plurality of first pixel data being converted by a level shift circuit of the first driving channel or outputs the preconfigured data to a digital-to-analog conversion circuit of the first driving channel.

6. The data driver of claim 1, further comprising an output selector coupled to the control unit and the first driving channel and configured to selectively output the first data voltage signal or output the first voltage to the first output node.

7. The data driver of claim 6, wherein the output selector selectively outputs the first data voltage signal being converted by a digital-to-analog conversion circuit of the first driving channel or outputs the first voltage to an output buffer of the first driving channel.

8. The data driver of claim 6, wherein the output selector is coupled between the polarity inversion circuit and the first output node and selectively outputs the first data voltage signal or outputs the first voltage to the first output node.

9. The data driver of claim 6, wherein the first voltage has the positive polarity or the negative polarity and is close to a middle voltage of an operating voltage range of the data driver.

10. The data driver of claim 1, wherein the polarity arrangement conforms column inversion.

11. The data driver of claim 1, wherein the control unit determines whether the polarity arrangement corresponding to each display line inverts according to a polarity indication signal transmitted from a timing controller, and the control unit generates a data control signal indicating that the polarity arrangement corresponding to each display line inverts or not.

12. The data driver of claim 1, wherein the control unit is configured to generate a polarity control signal for controlling the polarity inversion circuit.

13. A driving method for a data driver for driving a display panel, wherein the data driver comprises a control unit, a polarity inversion circuit, a first output node, and a plurality of driving channels, each driving channel comprising a latch circuit, a level shift circuit and a digital-to-analog conversion circuit, the driving method comprising:

generating, by a first driving channel of the plurality of driving channels, a first data voltage signal having a positive polarity output to the display panel according to a plurality of first pixel data;

generating, by a second driving channel of the plurality of driving channels, a second data voltage signal having a negative polarity output to the display panel according to a plurality of second pixel data, wherein the first data voltage signal is output to the first output node through the polarity inversion circuit during a first line period and the second data voltage signal is output to the first output node through the polarity inversion circuit during a second line period after the first line period, and the first line period and the second line period respectively belong to two consecutive frame periods; and determining, by the control unit, whether a polarity arrangement corresponding to each display line inverts;

in response to determining that the polarity arrangement of the display line changes, outputting a first voltage to the first output node during a third line period which is between the first line period and the second line period.

14. The driving method of claim 13, further comprising selectively outputting the plurality of first pixel data or output a preconfigured data corresponding to the first voltage to the first driving channel such that the first voltage is generated by the first driving channel.

15. The driving method of claim 14, wherein selectively outputting the plurality of first pixel data or output a preconfigured data corresponding to the first voltage to the first driving channel comprises outputting the plurality of first pixel data transmitted from a timing controller or outputs the preconfigured data to the latch circuit of the first driving channel.

16. The driving method of claim 14, wherein selectively outputting the plurality of first pixel data or output a preconfigured data corresponding to the first voltage to the first driving channel comprises outputting the plurality of first pixel data stored in the latch circuit of the first driving channel or outputs the preconfigured data to the level shift circuit of the first driving channel.

17. The driving method of claim 14, wherein selectively outputting the plurality of first pixel data or output a preconfigured data corresponding to the first voltage to the first driving channel comprises outputting the plurality of first pixel data being converted by the level shift circuit of the first driving channel or outputs the preconfigured data to the digital-to-analog conversion circuit of the first driving channel.

18. The driving method of claim 13, further comprising selectively outputting the first data voltage signal or output the first voltage to the first output node.

19. The driving method of claim 18, wherein selectively outputting the first data voltage signal or output the first voltage to the first output node comprises outputting the first data voltage signal being converted by the digital-to-analog conversion circuit of the first driving channel or outputs the first voltage to an output buffer of the first driving channel.

20. The driving method of claim 18, wherein selectively outputting the first data voltage signal or output the first voltage to the first output node is performed by an output selector, coupled between the polarity inversion circuit and the first output node.

21. The driving method of claim 18, wherein the first voltage has the positive polarity or the negative polarity and is close to a middle voltage of an operating voltage range of the data driver.

22. The driving method of claim 13, wherein the polarity arrangement conforms column inversion.

23. The driving method of claim 13, further comprising, by the control unit, determining whether the polarity arrangement corresponding to each display line inverts according to a polarity indication signal transmitted from a timing controller, and generating a data control signal indicating that the polarity arrangement corresponding to each display line inverts or not.

24. The driving method of claim 13, further comprising, by the control unit, generating a polarity control signal for controlling the polarity inversion circuit.

* * * * *